US008476841B2

(12) United States Patent
Brown et al.

(10) Patent No.: US 8,476,841 B2
(45) Date of Patent: Jul. 2, 2013

(54) POWER CONTROL

(75) Inventors: Aaron Brown, Blackburn North (AU); James Hamond, Kew (AU); Alex Knott, Elwood (AU)

(73) Assignee: Indice Pty Ltd, Camberwell (AU)

( * ) Notice: Subject to any disclaimer, the term of this patent is extended or adjusted under 35 U.S.C. 154(b) by 189 days.

(21) Appl. No.: 12/747,876

(22) PCT Filed: Apr. 24, 2009

(86) PCT No.: PCT/AU2009/000515

§ 371 (c)(1),
(2), (4) Date: Aug. 27, 2010

(87) PCT Pub. No.: WO2009/129581

PCT Pub. Date: Oct. 29, 2009

(65) Prior Publication Data

US 2011/0043112 A1 Feb. 24, 2011

(30) Foreign Application Priority Data

Apr. 24, 2008 (AU) ..... 2008902051

(51) Int. Cl.
*H05B 37/02* (2006.01)

(52) U.S. Cl.
USPC ..... 315/291; 315/300; 315/302; 315/308

(58) Field of Classification Search
USPC ..... 315/291, 299–300, 302, 307–308
See application file for complete search history.

(56) References Cited

U.S. PATENT DOCUMENTS

| | | | | |
|---|---|---|---|---|
| 5,371,439 | A * | 12/1994 | Griffin | 315/209 R |
| 5,583,402 | A | 12/1996 | Moisin | |
| 5,982,110 | A | 11/1999 | Gradzki | |
| 6,469,454 | B1 | 10/2002 | Mader | |
| 6,580,275 | B2 | 6/2003 | Hui | |
| 7,362,077 | B2 * | 4/2008 | Chen | 323/222 |
| 2004/0056607 | A1 | 3/2004 | Henry | |
| 2006/0017408 | A1 | 1/2006 | Hsieh | |
| 2006/0138972 | A1 * | 6/2006 | Hsieh et al. | 315/291 |
| 2007/0041200 | A1 * | 2/2007 | Walton | 362/341 |
| 2007/0090775 | A1 | 4/2007 | Ribarich | |
| 2008/0129220 | A1 * | 6/2008 | Shteynberg et al. | 315/291 |
| 2009/0230891 | A1 * | 9/2009 | Zhao et al. | 315/308 |

FOREIGN PATENT DOCUMENTS

| | | | |
|---|---|---|---|
| EP | 0 788 298 | A1 | 8/1997 |
| WO | 2004/070926 | A2 | 8/2004 |

OTHER PUBLICATIONS

International Search Report mailed Aug. 18, 2009, issued in corresponding International Application No. PCT/AU2009/000515, filed Apr. 24, 2009.

* cited by examiner

*Primary Examiner* — Jason M Crawford
(74) *Attorney, Agent, or Firm* — Christensen O'Connor Johnson Kindness PLLC

(57) ABSTRACT

An apparatus for driving a voltage source such as a discharge or LED lamp using a power booster receiving an AC voltage source configured through an inductor to turn on and off periodically in response to a duty cycle of a dimming control signal or a transformer starting a new cycle, for regulating a low voltage AC signal. The booster control circuitry adjusting the current feed to a determined target boost voltage according to sensed input from primarily a single comparator which compares any one of (but not limited to) a) the output boosted voltage, b) the globe current, or c) the inductor input current.

24 Claims, 5 Drawing Sheets

Figure 1: top level block diagram figure 2: controller abstract logical view 1. 12V Halogen Downlight
2. Alux Lamp
3. Panda Brand lamp
4. J-Right Lamp

POWER CONTROL

FIELD OF THE INVENTION

This invention relates to a power control system. In particular it is related to power control of a low power light source but is not limited to such.

BACKGROUND

The use of wall dimmers, to provide controlled light output from a luminaire, have been in use for quite some time. Many varieties of dimming for mains AC are available, however the most popular to date are known as leading edge and trailing edge dimmers. This technology was developed in the early $20^{th}$ century and relies heavily on the load, in most cases an incandescent bulb, to provide a sufficient load to correctly trigger and latch the dimmer's operation. The leading and falling edge dimmers are typically a silicon controlled rectifier (SCR) solid state device that may be latched by breakover voltage or by exceeding the critical rate of voltage rise between anode and cathode, just as with the Schottky diode. Leading edge dimmers will chop off the leading edge of the sine wave and trailing edge will chop off the trailing edge of the sine wave.

The current through the dimmer circuit controlling the SCR also controls the trigger mechanism via a RC network, where the resistance is the actual load (the globe) itself. This means that if the impedance is too high or the load is capacitive or inductive, the RC network/trigger level is unable to phase-shift the threshold significantly, and in some cases even becomes unstable, resulting in flickering (hence the reason why most existing energy saver globes do not dim effectively with existing infrastructure.)

The proliferation of low voltage (12v) 20 w-50 w dichroic halogen down lighting in world markets has driven the cost of manufacturing both the dimmer and the transformer (takes 240 VAC mains and converts it to 12 VAC) down to a point where they provide very 'dirty' power to the down light. The installation of such systems in commercial, industrial and residential premises requires careful selection of the transformer and dimmer as incorrect configurations can cause damage to both the dimmer, transformer and down light.

Energy efficient lighting places a much smaller load on both the dimmer and transformers (typically <10 W) resulting in the dimmer and transformer operating outside of specification. This results in instabilities which include;

1. Low load current causes the dimmer to operate below the specified minimum, causing poor dimming range and potential oscillations in the triggering of edges, which is visible in the globe (flickering.)
2. The instabilities on the leading and trailing edge can cause catastrophic inductive power spikes with magnetic transformers which can damage both the transformer and light
3. Many electronic transformers require low impedance loads (20 W-50 W) on its output to dampen the switch mode output of these devices and maintain stability
4. Providing a low impedance load is critical for many electronic transformers as they will "sense" the output current load to ensure its within a specification they have been designed for (typically, but not limited to 20 W-50 W)

There are three currently independent technology fields of concern: Cold Cathode Florescent Lamps (CCFLs), Light Emitting Diodes (LEDs) and halogen down light systems.

Cold Cathode Florescent Lamps (CCFLs) produce either a specific wavelength of light (such as red, green, blue, UV etc) or a certain bandwidth (warm white, hot white, blue white) without the need for the traditional heating element or filament found in normal florescent and incandescent lights.

Perhaps a predecessor, Compact fluorescent lamps (CFLs) are simply traditional fluorescent lamps folded or twisted into a compact form. The technology is more efficient than incandescent globes—primarily because CFLs do not require a filament to be heated to over 3000 degrees Kelvin. The existence of a hot filament is the primary cause of excessive heat, and over time the filament will fail either due to evaporation, or by mechanical stress caused by repeated heating and cooling as the light is switched on and off.

Unlike CFLs, Cold Cathode Florescent Lamps (CCFLs) have no filament, instead relying on excitation of the phosphor coating. CCFLs can provide over 100 lumens per watt depending on configuration, and last 20,000 hours or more due to the lack of heating filament fatigue. An AC voltage source of sufficient magnitude and frequency is necessary to excite the ions sufficiently enough to produce the desired light. Current in CCFLs is typically small—usually below about 6 mA. Optimal efficiency is achieved when the source frequency is above 10 KHz.

CCFLs have been used commercially for nearly 20 years, and can be found most commonly in LCD screens such as flat screen televisions and laptops. As the light output in these globes is so efficient, care must be taken to ensure that constant light is achieved by ensuring a stable power supply. Whilst light is emitted within microseconds of power being applied, the luminaire itself will warm up, getting brighter as the negative impedance behaviour after striking results in more current for a given voltage.

Commercial applications such as LCD televisions normally have complex control systems incorporating light and/or current sensors which ensure that light output is stable and controllable.

Typically a CCFL Tube has a diameter of 2 to 5 mm and tube length of 100 mm to about 500 mm. It typically requires an inverter to increase input voltages usually between 5 and 25 V with an output voltage of inverter of 400v to 1200V and globe current draw of about 5.0 to 6.0 mA. This produces a brightness of 18,000~30,000 cd/$m^2$ with a lifetime of some 30,000 hours, depending on manufacturer. It therefore provides high brightness, long lifetime, high reliability and easy installation.

LEDs are non-linear silicon-based PN junctions designed to emit a certain frequency of light when electrons jump a specific energy band gap when voltage is applied. The result is a narrow wavelength of light, completely selectable from IR to UV. However, this does cause a problem if broader spectrum light such as white or warm white is desired. Retransmitters are required, such as phosphor coatings but these have only limited success. Another issue is that producing large amounts of light as necessary in Halogen light markets require relatively massive emitters, which are formidably expensive, and require extensive heat dissipation to prevent destruction of the device by the heat stress caused by ohmic losses at large currents.

Another field of low power lighting are halogen downlights which are traditionally 12 volts as the original filament technology was not easily achieved with mains power (110 to 220V.) Using a complex system involving heat reflectors, UV filters, and filament maintaining halogen gas, halogen globes achieve slightly higher lumens per watt and life expectancy than traditional incandescent globes. Part of the incandescent family, the lamps use super-heated filaments which emit light according to the filament's physical temperature. Whilst operation is very simple, the bandwidth of electromagnetic energy emitted is wide, ranging from infra-red to UV. Most of this energy is converted into light invisible to the human eye, resulting in an extremely inefficient light source. Halogen lamps can achieve up to 15 lumens per watt, although most are around 10 usable lumens per watt due to leakage and the trend that the lower efficacy filaments tend to have longer life span.

As stated, most Halogen globes today run on 12 VAC and therefore require some form of power transformer to reduce mains voltage. The earliest transformers were magnetic in nature, consisting of different ratios of coil windings around an iron core. In more recent times, electronic transformers have been developed. These transformers operate very differently (switch mode) to normal transformers, are generally more efficient, and have added safety features such as overload cut-out protection, and soft start-up.

It is an object of the invention to provide a power supply to provide a low power feed for articles such as low power lights.

It is also an object of the invention to provide a means and method for power supply which overcomes or at least ameliorates one or more problems of the prior art.

SUMMARY OF THE INVENTION

In recent years, various manufacturers have attempted to produce energy efficient Halogen replacements, all of which appear to be based on the Light emitting diode (LED) technology. Current implementations use bucking circuits with standard recitifiers, the result of which is a capacitive load seen by the power source. This results in the device either not receiving enough voltage to drive the stepped down load, or catastrophic failure as high energy and or high frequency spikes are driven in by the source. Currently very few implementations in the market use anything more than a basic heatsink, some even include a small internal fan. Most do not have the ability to limit LED power based on die temperature, critical to ensure the rated efficacy and life span, due to the added cost and complexity of implementation.

In accordance with the invention there is provided a power control system including a circuit for boosting and/or bucking of a broad range of voltage sources in a manner which is controlled by an arbitrary number of feedback sensors and using only a single point of comparison, in doing so presenting a sufficiently low impedance to said voltage sources during periods of very low operation as to ensure correct and full operation in sensitive supplies such as halogen 12V inverters and dimming circuits The single point of comparison can be a logical comparison of a plurality of sensors which can include inductor current with boost voltage or globe current such that the highest of the sensed currents will trigger on or off the input current if at a reference threshold voltage.

In accordance with the invention there is provided a power control system including a current limited, voltage controlled booster using only a single comparator for comparing output target booster voltage with input current wherein when the AC input current is too low, the booster will appear as a very low impedance and it will lock the inductor to ground to provide voltage to target voltage booster enough to allow normal operation of both dimmers and electronic transformers, and when power resumes, either due to a transformer starting a new cycle, or a dimmer triggering, the inductor charge cycle will resume, to ensure only the required power is drawn.

The invention also provides an apparatus for driving a voltage source such as a discharge or LED lamp including:

- a power booster receiving an AC voltage source configured through an inductor to turn on and off periodically in response to a duty cycle of a dimming control signal or a transformer starting a new cycle, for regulating a low voltage AC signal;
- a booster control circuitry for providing a target voltage boost for discharging if at a determined target boost voltage;
  - wherein the booster control circuitry adjusting the current feed to a determined target boost voltage according to sensed input current, boost voltage or globe current;
  - and the booster control circuitry including a comparator for monitoring the voltage boost and if it falls below the determined target boost voltage providing current though the inductor of the power booster when it is pulled to ground, releasing when the target current is achieved, to increase target voltage boost and releasing target voltage boost if at the determined target boost voltage.

In one embodiment the booster control circuitry drives a balanced impedance transformer system involving two same type passive components on either the input or output of a transformer isolating the source or load impedance from the transformer wherein the passives can be resistors, capacitors or inductors and each passive is in series with the given transformer winding and the load, placed symmetrically opposite each other and of equal type and value result in symmetrical, or balanced load whereby values are pre-adjusted to provide the desired load balancing.

The booster circuitry can operate with a varied frequency carrier asynchronously and continuously adjusting the determined target voltage boost and comparing the target voltage boost to the determined target voltage boost.

The booster control circuitry can include

- a comparator for monitoring the voltage boost and if it falls below the determined target boost voltage providing current though the inductor of the power booster when it is pulled to ground, releasing when the target current is achieved, to increase target voltage boost and releasing target voltage boost if at the determined target boost voltage, and
- a comparator for monitoring the input voltage and if it exceeds the determined target voltage it is disconnected from the booster stage, reconnecting when the target voltage falls below said target.

The apparatus can have the duty cycle of the dimming control signal varied according to a relationship between the duty cycle of the inductor and the lamp current.

The apparatus can have a current controlled booster including a diode for allowing substantially instantaneous charging of the voltage booster when below target voltage and delaying reset of comparator when voltage target discharging to load.

The apparatus can include primarily a single comparator which compares any one of the following but not limited to:

a) the output boosted voltage,
b) the globe current,
c) the inductor input current.
d) The transformer primary current
e) Luminous output
f) Temperature
g) Motor speed The apparatus can have a multi-input comparator which adjusts target current by comparing input of one or more of (a) the output boosted voltage, (b) the globe current, (c) the inductor input current or the like. Preferably the multi-input comparator adjusts target current by comparing two or more of the inputs. More preferably the multi-input comparator can receive two or more inputs wherein the comparator is triggered when one or more of the inputs exceeds or reaches a predetermined condition, and wherein when at least one excitation pre-condition is reached the comparator changes state.

The apparatus can further comprise a buffer capacitor with a buck royer topology wherein software fires the buck at the precise time that the royer's tuned tank circuits approach zero voltage. The tank circuits can be tuned to a frequency natural to the transformer and fast enough to be efficient with the discharge lamp.

The apparatus can have the lamp current flowing through the discharge lamp varying directly with the duty cycle of the dimming control signal.

The apparatus can have the power regulator including a transistor-type and or silicon switch.

The apparatus can have the power regulator including a buck regulator.

The invention also includes a combined discharge lamp and apparatus for driving the discharge lamp, the discharge lamp and the apparatus further including a power control system including a circuit for boosting broad range of voltage sources in a manner which is controlled by an arbitrary number of feedback sensors and using only a single point of comparison, in doing so presenting a sufficiently low impedance to said voltage sources during periods of very low operation as to ensure correct and full operation in sensitive supplies such as halogen 12V inverters and dimming circuits.

The invention also provides a unified light source having a housing a body and an open shroud, wherein the housing is sized to contain a power control system and a helical or halo globe body mounted coaxial to the housing, the housing further including a concave inner reflector element fitting with a convex outwardly flanging substantially frustoconical outer reflector element wherein the helical globe body is in use locatable relative to the inner and outer reflector element to provide outward projection of light from the helical globe.

The reflector element helps extract additional lumen output by higher utilization of available light, thereby increasing efficiency. The reflector element achieves this improved efficiency by capturing and guiding light exterior to the light source, and also captures and guides light in the interior.

The reflector allows light normally trapped within a coiled helix to be directed out thus increasing the efficiency of a given reflector design. Without being bound by theory, it is believed that the closer the spacing between the helix coils the more effective the reflector element becomes at extracting light trapped within the coil for that given design. Further advantages include:

1. A halogen down light replacement requires a mechanically compact product and the reflector element is beneficial in this application to efficiently maximize the amount of luminary that can fit in a given space; and
2. The reflector element provides significant optical efficiency improvements for various lighting technologies not limited to but including CFL, CCFL, LED and the like.

The inner and outer reflector elements can be integral with the shroud of the housing.

The housing can include a protruding back section sized smaller than the body of the housing so as to be more readily inserted in small socket and electrically connected to power supply by protruding contacts.

It can be seen that the present invention provides an opportunity for a CCFL or other helix or halo globe system to be used in small downlight fixtures for the first time due to the novel power supply and further enhanced by the novel housing.

It can also be seen that the invention provides a Cold Cathode Florescent Lamp (CCFL) based retro-fitting product that can be installed into existing infrastructure for dichroic halogen down lights. This technology emits comparable amounts of light while consuming significantly less power. This reduction in power reduces running costs dramatically and coupled with its running time of 20,000 hours makes it an ideal candidate to replace halogen down light technology.

This is significant for two reasons:

1. The topology is a current limited, voltage controlled booster using only a single comparator;
2. When the AC input current is too low, the booster will appear as a very low impedance as it will lock the inductor to ground via Rs, typically <2 ohms, or enough to allow normal operation of both dimmers and electronic transformers. When power resumes, either due to a transformer starting a new cycle, or a dimming triggering, the inductor charge cycle will resume, ensure only the required power is drawn.

BRIEF DESCRIPTION OF THE DRAWINGS

In order that the invention is more readily understood an embodiment will be described by reference to the drawings wherein.

DESCRIPTION OF PREFERRED EMBODIMENT OF THE INVENTION

Figure 1:
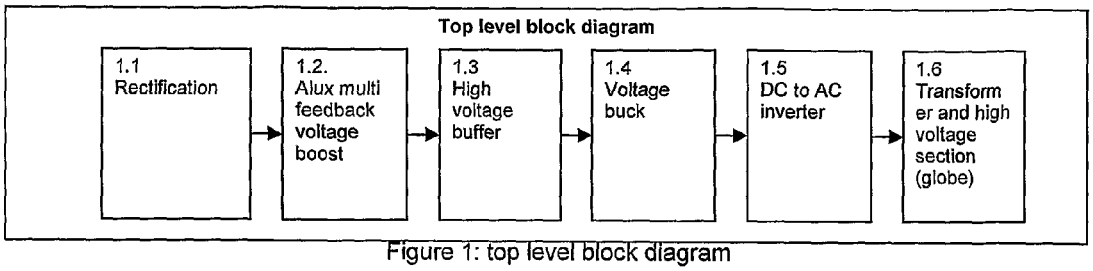
FIG. 1 is a block diagram of a top level of an embodiment of a power supply for a low voltage light in accordance with the invention.

Referring to the FIG. 1 of the drawings there is shown a simplified block diagram of an embodiment of a complex system consisting of both software and a unique hardware control system, which addresses the challenges of the prior art in a novel and innovative way.

As shown in FIG. 1, after simple AC rectification and smoothing (block 1.1), a novel current controlled voltage boost power supply topology (block 1.2) transforms an erratic AC source into a stable 100 Hz (or twice the source fundamental frequency) PWM voltage whose duty cycle is representative of the input powers RMS voltage. The PWM duty adjusts as the AC input rms power shifts. The boost itself is asynchronous, continuously adjusting as the target boost voltage varies. Vboost (the booster output voltage) is stored in a buffer capacitor (block 1.3) whose value of target voltage booster is monitored via a voltage divider leading to a comparator in the current controlled voltage boost power supply topology (block 1.2).

Figure 2:
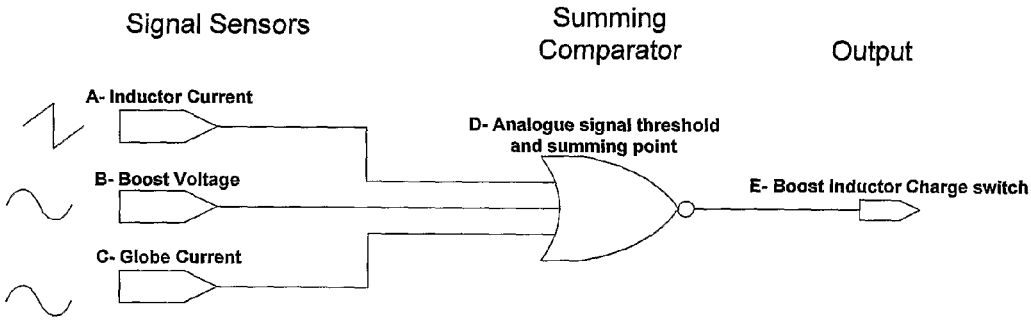
FIG. 2 is a logic block diagram of a booster of an embodiment of a power supply for a low voltage light in accordance with the invention.

Looking at the operation in a logic mode and with particular reference to FIG. 2 there is shown in a discrete logical sense, the circuit combines all inputs without allowing any interference which might bias the signal and therefore affect its accuracy. Each sensor is designed so that the target boundary, whether it be a current, voltage, phase or any other parameter, that can be measured, is weighted as to equal the comparator's (D) reference voltage at the desired value.

Effectively the output can be written as the following digital logic expression:

$$A+B+C=O$$

Of course there is no theoretical limit to the number of inputs.

The voltage seen by the comparator (D) input will be the highest of the inputs. If the highest input is above the reference voltage, the comparator will output a low, shutting off the boost inductor charge switch. If none of the inputs are above the threshold, the comparator will output high, charging the booster inductor. In this event, the inductor current is monitored by the Inductor current sensor (A), eventually the sensor will provide the comparator (D) with a signal which exceeds the threshold value, turning the inductor charge switch off. This allows the inductor to discharge into the booster output capacitor. The Inductor current sensor remains high for a short period even though the inductor current is no longer charging through current sensor Rs due to the low pass filter configuration.

Eventually the inductor current sensor (A) will discharge, reducing the signal voltage. If neither the other signals exceed the reference voltage, the inductor charging process will start again. If however the boost inductor discharging raised the boost voltage (B) or the globe current (C) sufficiently so that either one or both exceed the threshold, the comparator (D) will remain low. The circuit will remain in this state while sensor voltage does not exceed the threshold.

In this way, the controller can be said to operate until one or more boundaries are reached. In the example of the Invention globe ballast, when power is first applied, all signals will be low, turning on the comparator (D). The inductor will charge until the desired maximum current is reached, at which point the boost inductor will stop charging and begin discharging into the booster cap. This will continue until either the booster target voltage, or the globe current reaches the target value. If the CCFL is cold, or even old, the amount of output voltage required to reach the target running current is higher than if the glass is newer or warmer. This in turn may mean that the booster voltage sensor (B) reaches the threshold value before the globe current sensor (C). As the glass warms up however, its impedance will fall, resulting in higher current for the same given voltage. Eventually the globe current will rise to a sufficient value to reach the target threshold, which will mean that the comparator (D) will then be tracking against the globe current, and no longer the booster voltage.

This ensures the fastest warm-up period, without overdriving the globe with excessive power when warm.

The selection of an 'OR' or a 'NOR' is arbitrary, as the driving switch may need a low signal to activate. This is useful if two such power controllers, configured differently, are used to regulate both a buck and boost on the same power source where both comparators have shared inputs but independent outputs. In the invention solution, there is a negative switching of an inductive load with an N-FET which requires a logical high to activate, the 'NOR' gate was the logical solution. If an 'OR' gate is preferred, it is a simple matter of swapping the summing input and reference inputs to the comparator.

Figure 3:
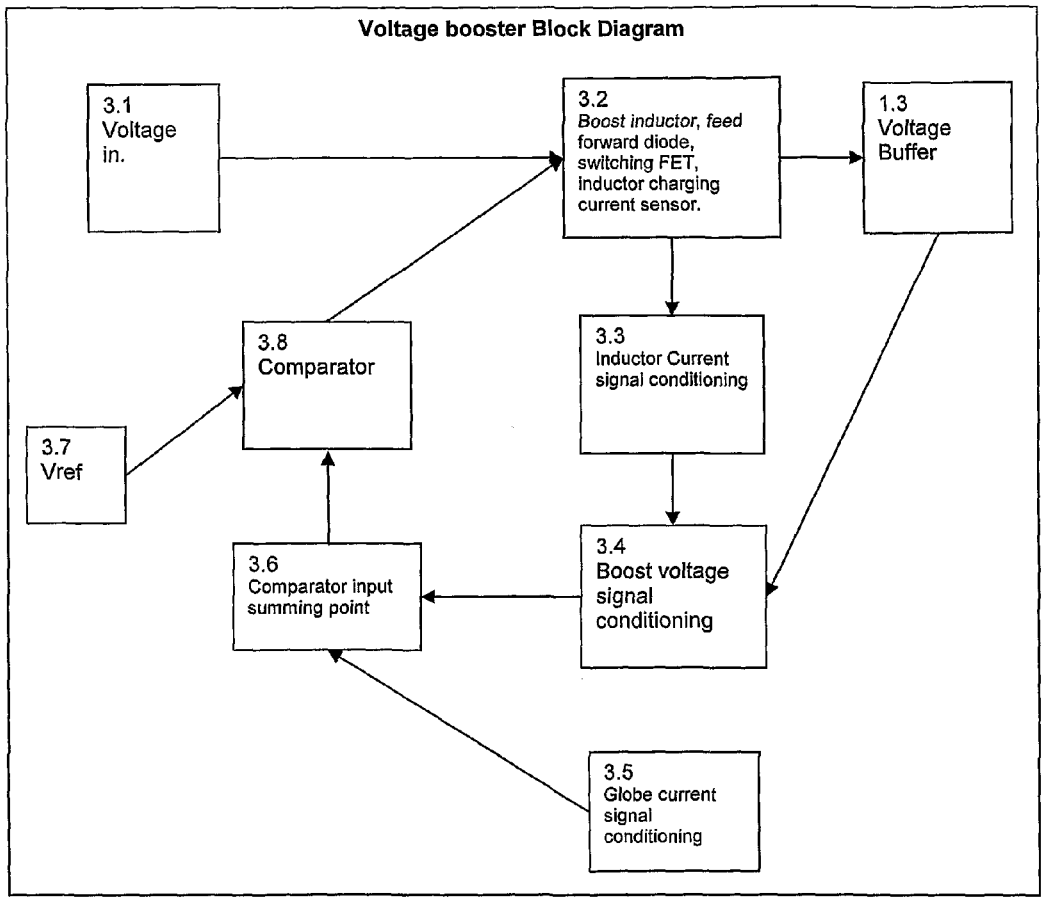
FIG. 3 is a block diagram of a booster of an embodiment of a power supply for a low voltage light in accordance with the invention.

With reference to a particular structure using the general structure of FIGS. 1 and 2, FIG. 3 shows the voltage in (block 3.1) and through a boost inductor (block 3.2) providing a high voltage buffer voltage (block 1.3). A comparator system applies in between and this system particularly works when Vin<Vout.

To ensure that the switching is not instantaneous and therefore preventing the system retriggering before providing a chance for balancing to a median, there is provided an inductor current discharge filter (block 3.3). A boost voltage divider (block 3.4) of the output voltage buffer Vout (block 1.3) enters a divided voltage to a comparator summing point (block 3.6). This is compared by comparator (block 3.8) to a Vref (block 3.7) so as to trigger if below the required voltage to change the duty cycle of the boost inductor and provide further current to the Vout.

When Vboost falls below the target value, the comparator will turn on, pulling an inductor connected to the rectifier capacitance to ground via a current sensing resistor Rs. The voltage at Rs is also fed into the comparator at the same junctions as Vboost voltage divider via a Schottky diode, where it is filtered by an RC network formed using the lower resistor in the Vboost voltage divider and a fast switching capacitor. The result is that when the inductor reaches a current high enough to trigger the comparator (through the Schottky) the high peak is stored in the capacitor instantaneously, but only discharges via the RC network. This is critical to ensure that the inductor does not over charge, and is allowed sufficient time to discharge into the buffer capacitor Once the peak current is detected, the comparator will switch off, forcing the charged inductor to discharge into the buffer capacitor via another diode as per a normal booster configuration. As the inductor is discharging, Vboost will rise accordingly. The filter RC network at the comparator input will also discharge. The result is that in time, either Vboost will reach a high enough level as to hold the voltage divider input to the comparator high, or the RC network will discharge, causing the comparator to turn on, charging the inductor once again.

This is significant for two reasons. First the topology is a current limited, voltage controlled booster using only a single comparator. Secondly when the AC input current is too low, the booster will appear as a very low impedance as it will lock the inductor to ground via Rs, typically <2 ohms, or enough to allow normal operation of both dimmers and electronic transformers. When power resumes, either due to a transformer starting a new cycle, or a dimming triggering, the inductor charge cycle will resume ensuring only the required power is drawn.

The buffer capacitor ensures enough stable energy is available to a synchronous buck-royer topology. Software controlled, the buck is fired at the precise time that the royer's tuned tank circuits approach zero voltage. Typically the tank circuits (both the primary and secondary) are tuned to a frequency natural to the transformer, and fast enough to be efficient with the CCFL. The current solution uses approximately 60 KHz, though this is deemed to be arbitrary for a given transformer. The buck period can be adjusted to accelerate the normally slow warm up periods of the CCFL.

As the booster supplies such a well controlled, stable output, the buck duty can remain fixed, which results in a more stable royer frequency. In using a software controlled, synchronous royer network, the current solution uses high current FETs instead of transistors, which typically cannot deliver the same efficiency at the relatively low voltages supplied by the halogen transformers.

Figure 4:
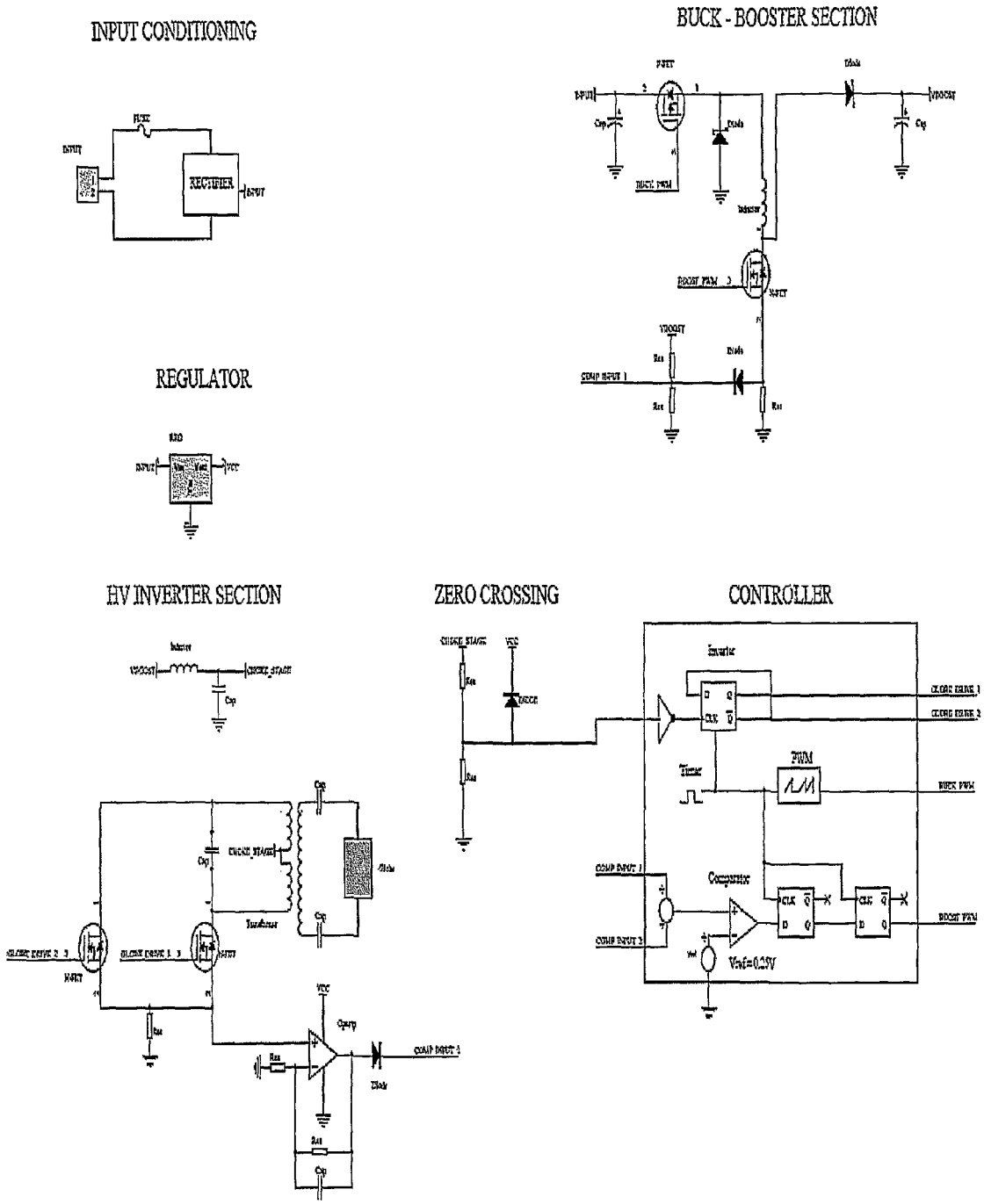
FIG. 4 are segmented circuit diagrams of sections of an embodiment of a power supply for a low voltage light in accordance with the invention.

Referring to FIG. 4 there are segmented circuit diagrams of sections of the power supply for a low voltage. FIG. 4 depicts the various subsections described in this document, specifically:

1. Input Conditioning,
2. Booster Section,
3. Buck Section,
4. controller section
5. Inverter Section, and
6. Voltage regulator.

Items 1, 3, 5 and 6 are all fairly standard configurations, though the input conditioning section has a clamping zener diode to prevent high voltage spikes from reaching the rest of the circuit. Also the current sensor configuration on the secondary stage of the inverter allows globe current monitoring. The regulator is shown as an example, in the event the controller circuit requires it.

The Booster section shows how a standard booster configuration is modified to include a current sensing resistor at the source of the switching transistor, which is filtered before sending to the comparator as described. In addition, a voltage divider is present to allow Booster Voltage monitoring via the same feedback path.

The Controller section might only contain the comparator in the event the target configuration has a self oscillating royer circuit. The invention configuration however implements a synchronous inverter with a voltage buck, which is included in the illustration for clarity. All semiconductor components, including regulator, rectifying bridge, transistors, diodes and even some capacitors and resistors can be assembled independently, or within a single integrated circuit.

When the above technology is aimed at the existing 12 VAC MR16 halogen globe market, the form factor must fit in most existing sockets and the entire ballast controller had to reside within a double sided 36 mm diameter PCB, with about 12 mm of depth.

Figure 5:
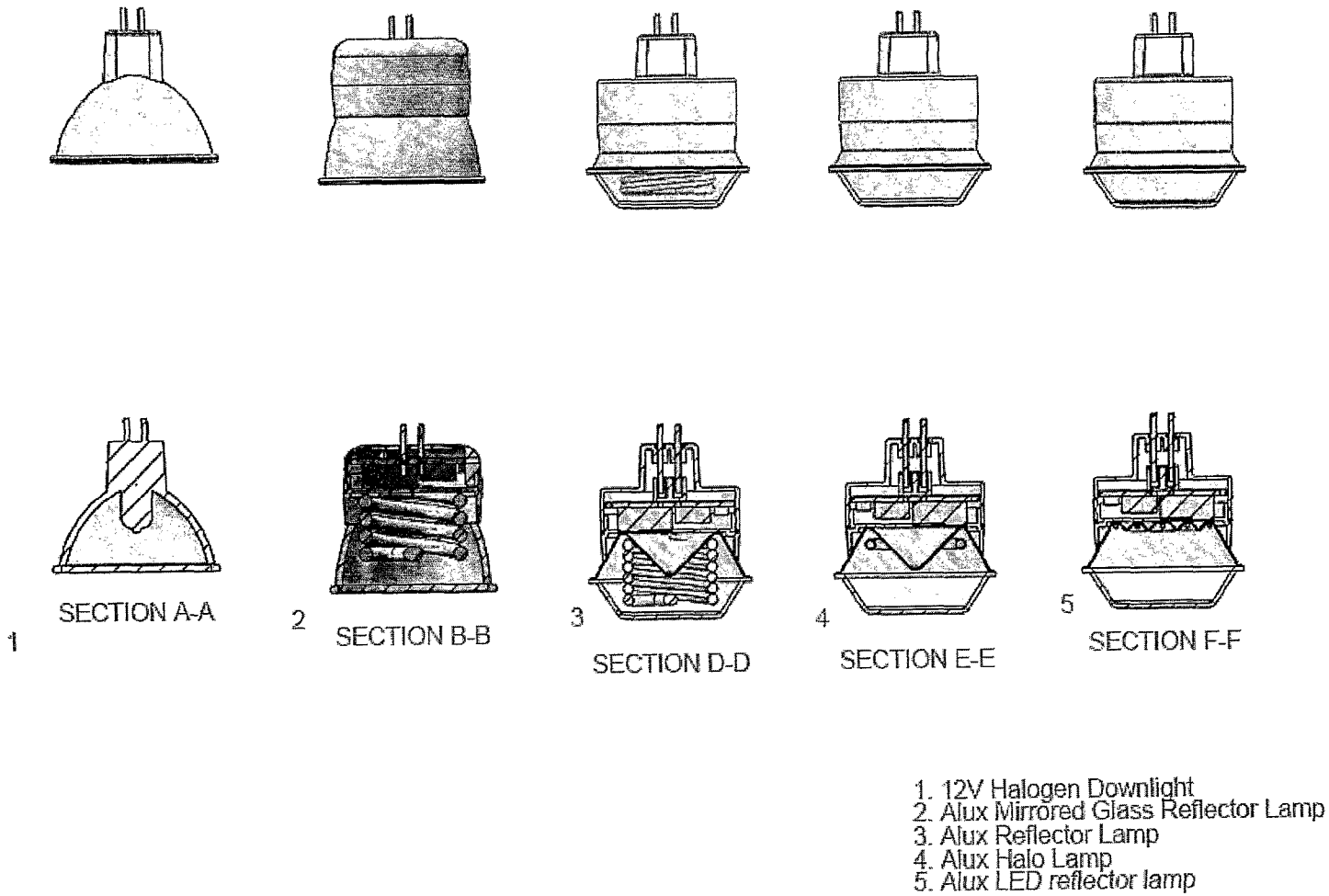
FIG. 5 are side elevations and cross sectional views of prior art halogen, a CCFL with a power supply for a low voltage light in accordance with the invention with extended housing, and a CCFL with a power supply for a low voltage light in a novel modified housing in accordance with the invention.
Figure 6:
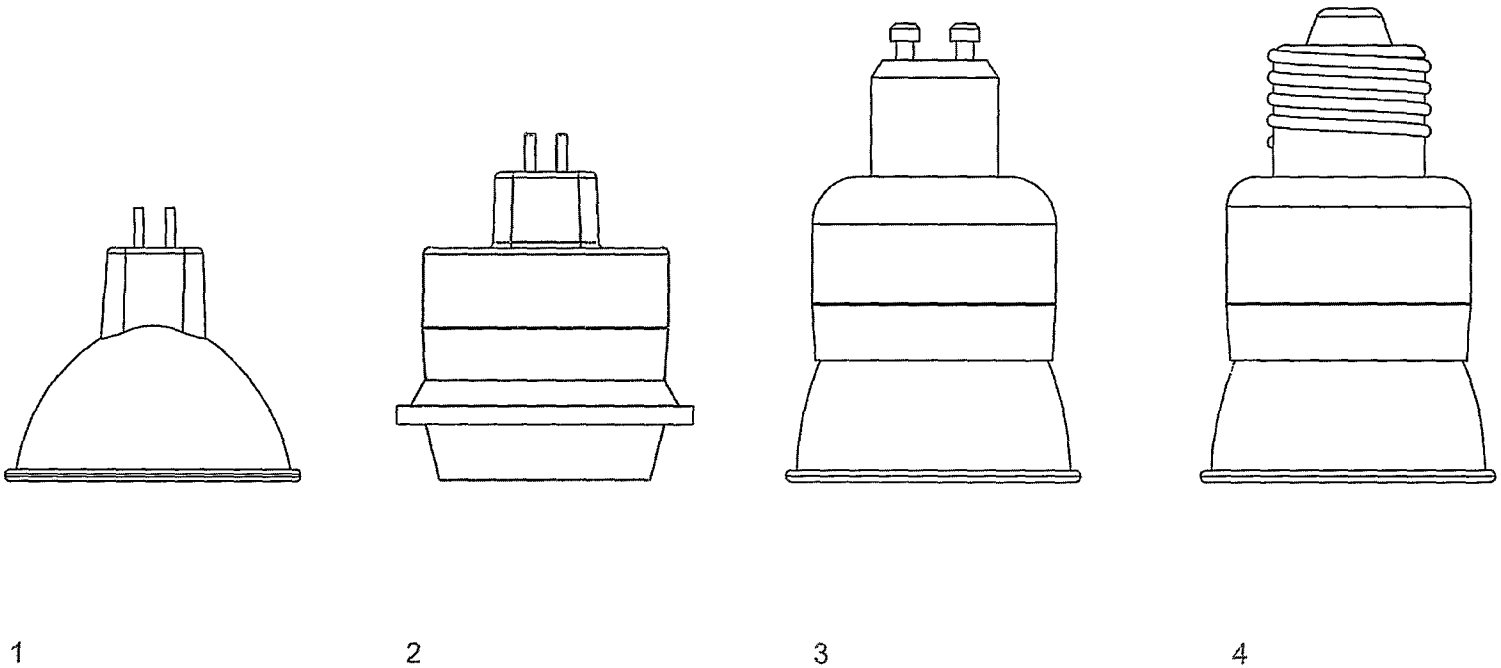
FIG. 6 are comparative side elevations of novel design (No. 2) compared with other sized prior art light structures.

The invention when applied to the halogen globe includes a combined discharge lamp and apparatus for driving the discharge lamp including a housing having Referring to FIG. 5 there is shown a comparison of the form factor of a typical halogen globe with potential CCFL configurations of the present invention. As can be seen, the CCFL Helix is far larger than the traditional 'point source' Halogen incandescent globe. The consequence of which is that the standard parabolic mirror used to focus the point source is no longer effective, given that the CCFL approximates closer to a cylinder whose dimensions consume most over the available volume.

Globe 2 of FIG. 5 illustrates how the helix and ballast can almost sit within the MR16 connector and the glass plate at the bottom, however this results in much of the light output reflecting internally, reducing the total output. Another issue with the Helix form factor is that nearly half the total luminaire surface area is inside the helix, resulting in further internal losses. Additionally, as the MR16 wedge has been replaced with the ballast housing, some female connectors will be incompatible.

Despite these issues, some users may find the form factor more aesthetically appealing, particularly as the globe is completely recessed.

Globe 3 of FIG. 5 is a variant on the globe 2 in that the reflector depth has been reduced to ensure that the reflector angle is better optimised to form a beam out of the globe rather than reflected internally. Additionally, an internal inverted reflector is present to focus as much of the helix internal light as possible outwards, thus making more efficient use of the available light. The reflector is fitted with a convex outwardly flanging frustoconical outer reflector element. This is all done at the expense of having the helix protruding partially out of the housing, which while may result in some diverging light (depending on the application) means that the MR16 wedge is still present, allowing greater compatibility with existing MR16 female sockets.

It has been shown that the power supply for a low voltage has substantial advantages. The current globe structure is stable but there are a need for further enhancements which include:

1. Some electronic transformers remain dimmer than desired due to Power control's minimal load.
2. Unstable dimming in some existing dimmer configurations due to insufficient load.
3. Whilst voltage and input current is controlled, the lamp current is not regulated directly, contributing to the lengthy warm up period.

The first issue can be tuned for using the existing topologies. However, this is at the expense of dimming stability with some dimmers. A simplistic solution is to increase the rectifier capacitance, which will increase rms power with the more 'fickle' transformers, but as the globe's load becomes more and more capacitive, it causes beat patterns with some dimmers, which is annoying for the user. Further advances are believed possible by increasing the maximum booster switching speed and current, and increasing the buffer capacitance.

Solutions has at the easiest fix to simply have more globes on the dimmers, as is commonplace in normal household installations. Normal halogen globes are almost always configured with 2 or more globes per dimmer, which means even with Power control's load of only 6 W, four such globes results in 24 W and is therefore above the minimum dimmer requirement.

Solutions for the third issue follow, as the voltage and current are monitored in parallel using only one comparator, it is possible to add yet another monitor—that of the globe current. By using yet another current shunt, this time in the high voltage, low current output stage, it is possible to monitor the globe current wave form (FIG. 2 block 2.5.) By rectifying and smoothing the signal sufficiently to prevent chasing, the resulting 'sensor' can be combined with the others (boost current and voltage) similar to an 'OR' gate (or in our particular case, a 'NOR') in digital logic.

In the case of our analogue system, anything above the comparator threshold is considered a '1' while anything below is a '0'. The significance of this is that we can now monitor an arbitrary number of inputs, any of which can turn the booster off by going above the target threshold. For example, when power is applied for the first time, the inductor current, the booster voltage, and the globe current will all be well below threshold. This will cause the 'NOR' gate to go high as all inputs are low, which then starts the inductor charging. Eventually, the inductor current will reach the threshold, causing the NOR to register a '1' on the current sense line, turning the gate off. If the desired boost voltage is detected, it will also be seen as high, keeping the NOR gate output low regardless of the other inputs, the same goes for the globe current.

This will greatly decrease warm up time as the respective desired values (inductor current, boost voltage, globe current) can be 'programmed' so that the maximum boost voltage is actually slightly high. This means that until the globe current is achieved, the boost voltage is greater initially. As the globe warms up, the globe impedance will fall until the globe current can be maintained by a lower booster voltage, which will no longer trigger as a high due to the NOR gate tracking on the globe current.

In practise, it is important to ensure that the individual sensors do not interfere, as although we treat them as virtual digital signals, they are of course still analogue. In the Power control application, we found we could combine the booster voltage and inductor current filter into one which saved on components and PCB space, although conceptually they are two separate signals. We could, if required, monitor the output voltage using the same method as described. Combining and isolating the signals is simple enough using diodes (FIG. 2 block 2.7,) and must be performed prior to signals reaching the comparator (FIG. 2 block 2.8.) The voltage at the comparator input will simply be the greater of the inputs. It is this value which is compared with the reference voltage (FIG. 2 block 2.7.)

The understanding of the importance and inventiveness of the invention can be more enhanced by reviewing the process in which the invention was derived. It can be seen that the development of the invention derived from two distinct fields of CCFL and low power Halogen lights. However the usage of each part of the technology was not straightforward and required developments to overcome particular problems associated in combining such diverse areas.

The voltage output from the broad variety of Halogen ballast (with or without dimmers) can vary considerably. This means that a great deal of conditioning is necessary before it can effectively power high-efficiency lighting systems such as CCFLs. Because CCFLs don't rely on heated elements which average out power fluctuations through sheer energy capacitance of ultra-high temperatures, even the most minor fluctuation in supply power can result in anything from fluctuations in light output, to catastrophic failure.

On examining the controllers used in LCD displays, there was found a complexity and form factor to be unusable because the input voltage had to be precise, and the efficiency was only about 50%. The cost, also, was prohibitive.

Looking at the existing 240 volt CCFL and CFL circuits, most examples found relied on the most basic Royer circuit using a transformer feedback circuit driving transistors for the high frequency AC inversion. This worked well with enough stable, high voltage AC supplies, but was ineffective with most electronic transformers and any form of dimming. Also problematic was the relatively high currents necessary with the 12 VAC supplies compared with 240 VAC, as the transistors would drop large amounts of power, reducing efficiency (and life of the ballast) considerably.

A first attempt was to rectify, filter and invert the supply coming straight out of the Halogen ballast using Field Effect Transistors (FETs) and send it to a step up transformer to a CCFL globe. This, configuration was the equivalent to joining block 1.1 straight to 1.4 in FIG. 1. However there are major limitations to this, some of which are:

1. Light output fluctuated due to hypersensitivity to mains power fluctuations.
2. Surges and spikes caused circuit burnout.
3. Dimmers would fluctuate when dimming.
4. Dimmers would not dim beyond half brightness.
5. Some electronic transformers would not turn on due to insignificant load.
6. Different transformers produced different average light output (output RMS voltage varied).
7. Fluctuating voltage rails meant that the natural resonant frequency drifted, resulting in unstable and inefficient light output.
8. Lower rms voltage meant larger currents in the transformer primary, resulting in higher ohmic losses.

Through studying aspects such as AC power oscillations and existing mains and Halogen infrastructure such as dimmer topologies and ballast varieties, it was found that:

1. Dimmers require a minimum load of typically 10W to operate, and the load must not have significant phase shifting (capacitive or inductive).
2. Electronic transformers require minimum loads to regulate output.
3. Magnetic transformers may output dangerously high voltage spikes when configured with dimmers, particularly if the chosen dimmer is the incorrect type (falling vs rising edge).

Additionally, on studying the characteristics of CCFLs it was found that:

1. While CCFL glass tubes come in a variety of lengths which proportionally increase to the total impedance, nominal running current is 6 mA for best light output and useful life expectancy.
2. Impedance is slightly capacitive, and changes with temperature—the warmer the globe, the lower the impedance which results in more current for the same input voltage. This results in the light getting brighter over a few minutes as the temperature rises to approximately 40-50 degrees, if a constant voltage is supplied.
3. The warm up period is dependant upon factors such as ambient temperature, input power, and age of the glass.

A variety of solutions were tried, including replacing the fixed buck period of voltage buck feeding the transformer primary with a common asynchronous single comparator current regulating buck. The result was a more stable over all light output across varied input voltages. However dimming was still unstable as the buck was unable to impose a sufficient load on the 12 VAC transformer nor on particular dimmers.

Reviewing the major issues mentioned earlier, it was apparent that what was necessary was a stable supply with high enough voltage to ensure low RMS current that would also impose a heavy load on the supply rails particularly when input was low.

The change to previous approaches was a booster circuit, as when charging, the booster inductor is pulled to ground from the input rail, and is therefore seen as low impedance by the supply. The problem was, unlike buck supplies where the output is in the correct phase so that a comparator alone can simply turn on and off to increase supply when the desired input level is to low, boost topologies typically require either state information or complex phase inversion. It is believed most existing topologies are synchronous, requiring a fixed clock to synchronise any transformations required with the boost initiation. Asynchronous would probably require a number of comparators to monitor charging current, maximum voltage, and minimum voltage independently.

However to ensure ready solution it was determined that we needed to use a single comparator, partly because it was available on the selected micro controller with fast switching, and partly because any attempt to introduce a traditional PWM based z-transform discrete control system would require a major step up in CPU power, cost, size, and complexity.

This led us to experiment with using one comparator to monitor the current though the inductor when it was pulled to ground, releasing when the target current was achieved, sending the charge current to a buffer cap whose voltage would increase until the booster input power reached equilibrium with the buck and inverter draw. The first obvious issue this would have is that the instant the inductor hit the desired target current (monitored through a shunt resistor) the comparator would turn off, disengaging the shunt, resulting in the comparator detecting a low, pulling the inductor to ground almost instantaneously, resulting in runaway continuous current.

The fix was a filtered RC network, effectively delaying the time before the comparator detected low input. Unfortunately, the delay worked both ways—the rising edge was also delayed, which meant that not only was the comparator too slow to respond to the target current, it still turned back on immediately as the filter only just got to the target value before the inductor was turned off anyway, resulting in very little discharge being necessary.

To solve this, we introduced a diode which would instantly charge the filtering capacitor when the shunt voltage was increasing due to increasing inductor current. This meant that during charging, the comparator was monitoring the instantaneous current of the inductor, and would switch off at the correct moment. As the diode would not allow current to flow back into the shunt, the RC filter would then discharge at the desired rate, one that would allow the inductor sufficient time to discharge into the buffer capacitor before triggering the comparator to turn on again.

Basically, we had come up with a very simple yet effective zero order current controlled booster topology, using only one comparator.

We found this worked very well—as long as absolutely nothing went wrong with the buck stage load. It meant that there was very little tolerance for the CCFL glass and for inevitable component tolerance variations. If for any reason the load did not drain sufficient power from the buffer capacitor, the continuous current from the booster would eventually drive the buffer voltage to failure, destroying literally everything remotely connected to it.

The solution was to impose a voltage limit on the voltage booster. In the end, this was achieved by the addition of one resistor. A voltage divider was created by connecting the inductor RC filter resistor to the buffer capacitor by a resistor value which would result in the target threshold being hit if the output voltage was to exceed a maximum desired voltage. This is illustrated in the connections between blocks 2.3, 2.4 and 1.3 in FIG. 2.

This modification meant that it was now possible to target a voltage, programmable by the voltage divider ratio, and that it could be sought at a maximum current rate. The design is now a current limited, voltage regulated, asynchronous booster circuit, and still only uses one comparator.

The repercussions of this were that we could effectively guarantee the voltage input to the buck and inverter section, for any given input wave form. This meant little dependence on component tolerances, durability, and the desired sufficiently low impedance desired for dimming in existing Halogen systems. The fixed high buffer voltage (high relative to the input voltage) resulted in lower inverter current, and was roughly a square wave running at twice mains frequency (100 Hz) meaning that although the CCFL was always at the same brightness during 'on' periods, the duty cycle would change corresponding to the dimmer-cropped signal, resulting in PWM controlled dimming, for a wide variety of transformers and dimmers.

It can be seen in one form that the booster control circuitry includes a balanced impedance transformer system involving two same type passive components on either the input or output of a transformer isolating the source or load impedance from the transformer wherein the passives can be resistors, capacitors or inductors and each passive is in series with the given transformer winding and the load, placed symmetrically opposite each other and of equal type and value result in symmetrical, or balanced load whereby values are pre-adjusted to provide the desired load balancing.

In an application pertaining to fluorescent lighting, the passive would be a capacitor. Such a configuration provides physical isolation which can have many benefits, including the ability to dereference a load and a source. In such an application, the capacitor values need not be of equal value, depending on design requirements.

A balanced capacitive inverter has the following advantages to driving fluorescent lighting mediums including but not limited to CCFL, CFL and EEFL. These advantages have applications in other industries to;

1. Reduces mechanical oscillation in transformers through isolating non linear loads such as fluorescent lamps and the like
2. Balances any capacitive coupling with nearby metals thereby reducing dangerous voltages.
3. Balanced coupling greatly reduces any leakage current which would normally occur through surrounding metals.
4. Lower voltage rating capacitors can be used for voltage inverters as the voltage is shared across more than one component
5. The isolating capacitors can be one or more in series to meet the application requirements. An example of this would be voltage rating.

The balanced passive transformer system provides isolation for a transformer from other non linear loads and has general applications.

It should be understood that the above description is of a preferred embodiment and included as illustration only. It is not limiting of the invention. Clearly variations of the power supply and its uses would be understood by a person skilled in the art without any inventiveness and such variations are included within the scope of this invention as defined in the following claims.

In particular the invention can apply to External Electrode Florescent Lamps (EEFLs). These are a close relative of the CCFL. EEFLs do away with the need for electrodes protruding into the glass by capacitively coupling at each opposing end of the tube. The result is a much longer life span as electrode degradation is virtually eliminated. Electrically, EEFLs are compatible with the same sort of controllers used with CCFLs, with only minor tuning necessary. Therefore it will be clearly understood the application of the invention as it relates to EEFLs.

The invention can also apply to use for other low and high power means. This could include control systems for more effective LED based lighting solutions and scalable power supplies for low and high voltage applications in AC and DC. This is significant as current LED 12V downlight replacements are incompatable with existing dimming infrastructure.

The invention claimed is:

1. A power control system including a circuit for boosting and/or bucking a broad range of voltage sources in a manner which is controlled by an arbitrary number of feedback sensors and using only a single point of comparison for either boosting and/or bucking, and presenting a sufficiently low impedance to said voltage sources during periods of very low operation as to ensure correct and full operation in sensitive supplies such as halogen 12V inverters and dimming circuits.

2. A power control system according to claim 1 wherein the single point of comparison can be a logical comparison of a plurality of sensors including inductor current with boost voltage or globe current such that the highest of the sensed currents will trigger on or off the input current if at a reference threshold voltage.

3. A power control system including a current limited, voltage controlled booster using only a single comparator for comparing output target booster voltage with input current;

wherein when the AC input current is too low, the booster will appear as a very low impedance and it will lock the inductor to ground to provide voltage to target voltage booster enough to allow normal operation of both dimmers and electronic transformers, and when power resumes, either due to a transformer starting a new cycle, or a dimmer triggering, the inductor charge cycle will resume, to ensure only the required power is drawn.

4. An apparatus for driving a voltage source such as a discharge or LED lamp including:

a power booster receiving an AC voltage source configured through an inductor to turn on and off periodically in response to a duty cycle of a dimming control signal or a transformer starting a new cycle, for regulating a low voltage AC signal;

a booster control circuitry for providing a target voltage boost for discharging if at a determined target boost voltage;

wherein the booster control circuitry adjusting the current feed to a determined target boost voltage according to sensed input current, boost voltage or globe current;

and the booster control circuitry including a comparator for monitoring the voltage boost and if it falls below the determined target boost voltage providing current through the inductor of the power booster when it is pulled to ground, releasing when the target current is achieved, to increase target voltage boost and releasing target voltage boost if at the determined target boost voltage.

5. An apparatus for driving a voltage source such as a discharge lamp according to claim 4 wherein the booster control circuitry includes a balanced impedance transformer system involving two same type passive components on either the input or output of a transformer isolating the source or load impedance from the transformer wherein the passives can be resistors, capacitors or inductors and each passive is in series with the given transformer winding and the load, placed symmetrically opposite each other and of equal type and value result in symmetrical, or balanced load whereby values are pre-adjusted to provide the desired load balancing.

6. An apparatus for driving a voltage source such as a discharge lamp according to claim 5 wherein when the discharge lamp is fluorescent lighting, the passive is a capacitor.

7. An apparatus for driving a voltage source such as a discharge lamp according to claim 4 wherein the booster control circuitry includes:

a comparator for monitoring the voltage boost and if it falls below the determined target boost voltage providing current though the inductor of the power booster when it is pulled to ground, releasing when the target current is achieved, to increase target voltage boost and releasing target voltage boost if at the determined target boost voltage, and a comparator for monitoring the input voltage and if it exceeds the determined target voltage it is disconnected from the booster stage, reconnecting when the target voltage falls below said target.

8. An apparatus for driving a voltage source such as a discharge lamp according to claim 4 wherein the booster control circuitry includes a multi-input comparator which adjusts target current by comparing input of one or more of (a) the output boosted voltage, (b) the globe current, (c) the inductor input current or the like, and wherein the multi-input comparator adjusts target current by comparing two or more of the inputs, and wherein the comparator is triggered when one or more of the inputs exceeds or reaches a predetermined condition, and wherein when at least one excitation pre-condition is reached the comparator changes state.

9. An apparatus for driving a voltage source such as a discharge or LED lamp according to claim 4 wherein the booster circuitry can operate with a varied frequency carrier asynchronously and continuously adjusting the determined target voltage boost and comparing the target voltage boost to the determined target voltage boost.

10. An apparatus for driving a voltage source such as a discharge lamp according to claim 4 wherein the duty cycle of the dimming control signal varied according to a relationship between the duty cycle of the inductor and the lamp current.

11. An apparatus for driving a voltage source such as a discharge lamp according to claim 4 wherein the current controlled booster includes a diode for allowing substantially instantaneous charging of the voltage booster when below target voltage and delaying reset of comparator when voltage target discharging to load.

12. An apparatus for driving a voltage source such as a discharge lamp according to claim 4 further including primarily a single comparator which compares any one of the following but not limited to:

a) the output boosted voltage, b) the globe current, c) the inductor input current, d) the primary transformer current, e) luminous flux, f) Temperature, g) Motor speed.

13. An apparatus for driving a voltage source such as a discharge or LED lamp according to claim 4 wherein the lamp current flowing through the discharge lamp varying directly with the duty cycle of the dimming control signal.

14. An apparatus for driving a voltage source such as a discharge lamp according to claim 4 wherein the power regulator includes a transistor-type switch.

15. An apparatus for driving a voltage source such as a discharge lamp according to claim 4 wherein the power regulator includes a buck regulator.

16. A combined discharge lamp and an apparatus for driving the discharge lamp using an apparatus for driving the discharge lamp according to any one of claims 4 to 15.

17. A unified light source having a housing with an open shroud, wherein the housing is sized to contain a discharge lamp and an apparatus for driving the discharge lamp using an apparatus for driving the discharge lamp according to any one of claims 4 to 15 and wherein the discharge lamp is a helical globe body mounted coaxial to the housing.

18. A unified light source according to claim 17 wherein the housing further includes a concave inner reflector element fitted with a convex outwardly flanging substantially frusto-conical outer reflector element wherein the helical or halo globe body is in use locatable relative to the inner and outer reflector element to provide outward projection of light from the helical globe.

19. A unified light source according to claim 18 wherein the inner and outer reflector elements can be integral with the shroud of the housing.

20. A unified light source according to claim 17 wherein the centre cone reflector allows light normally trapped within a coiled helix, halo or surface (LED ring) to be directed out thus increasing the efficiency of a given reflector design.

21. A unified light source according to claim 17 wherein the closer the spacing between the helix coils the more effective the centre cone becomes at extracting light trapped within the coil for that given design to efficiently maximize the amount of luminary that for a given space.

22. A unified light source according to claim 17 wherein the reflective centre cone offers significant optical efficiency improvements for various lighting technologies not limited to but including CFL, CCFL, LED and the like.

23. A unified light source according to claim 17 wherein the housing includes a protruding back section sized smaller than the body of the housing to be readily inserted in an electric socket and thereby electrically connected to power supply by protruding contacts.

24. A combined discharge lamp and an apparatus for driving the discharge lamp, the discharge lamp and the apparatus further including a power control system including a circuit for boosting broad range of voltage sources in a manner which is controlled by an arbitrary number of feedback sensors and primarily using only a single point of comparison, to present a sufficiently low impedance to said voltage sources during periods of very low operation to ensure correct and full operation in sensitive supplies such as halogen 12V inverters and dimming circuits.

* * * * *